US007946927B2

(12) United States Patent
Bowers

(10) Patent No.: US 7,946,927 B2
(45) Date of Patent: May 24, 2011

(54) GOLF TRAINING AID

(75) Inventor: Bruce Bowers, Scotch Plains, NJ (US)

(73) Assignee: Bruce Bowers, Scotch Plains, NJ (US)

( * ) Notice: Subject to any disclaimer, the term of this patent is extended or adjusted under 35 U.S.C. 154(b) by 0 days.

(21) Appl. No.: 12/456,320

(22) Filed: Jun. 15, 2009

(65) Prior Publication Data

US 2010/0317450 A1 Dec. 16, 2010

(51) Int. Cl.
*A63B 69/36* (2006.01)

(52) U.S. Cl. ..... 473/257; 473/266

(58) Field of Classification Search ..... 473/219, 473/257, 260, 261, 262, 264, 265, 266, 271, 473/272, 273, 275, 276, 277
See application file for complete search history.

(56) References Cited

U.S. PATENT DOCUMENTS 4,116,447 A * 9/1978 Becker ..... 473/276
4,928,975 A * 5/1990 Skelley et al. ..... 473/264
5,255,921 A * 10/1993 Spence ..... 473/218
5,303,926 A * 4/1994 Owens et al. ..... 473/261
5,439,226 A * 8/1995 Luedtke ..... 473/232
6,949,030 B1 * 9/2005 Gauer ..... 473/257
7,063,626 B2 * 6/2006 Cardosi ..... 473/257
7,150,683 B2 * 12/2006 Bender ..... 473/266

* cited by examiner

*Primary Examiner* — Nini Legesse
(74) *Attorney, Agent, or Firm* — Ezra Sutton, P.A.

(57) ABSTRACT

The present invention is for a golf training aid designed to teach a golfer the correct path to swing a golf club from the set up position to the top of the swing to impact and follow through. Specifically, this invention includes a golf training aid in the form of a tubular frame with adjustable poles, preferably made of light weight aluminum or PVC (polyvinyl chloride). The golf training aid trains a golfer by using a swing board which is set up at the correct shaft angle plane which guides the shaft of the club back approximately 18 inches. As a result of the slight friction between the swing board and the golf club shaft, the golfer will feel the correct path of their swing going back. Two shaft plane guides are provided at the waist height of the golfer. The shaft plane guides are adjustable and permit the golfer to identify their correct backswing and downswing. On the downswing, the golfer keeps the club below the shoulder plane guide and above the shaft plane guide and the swing board, thus putting the club into the correct downswing position. The club will return slightly above the swing board to impact and stay outside the follow through guide (shaft plane guide).

4 Claims, 10 Drawing Sheets

GOLF TRAINING AID

FIELD OF THE INVENTION

The present invention relates to a training aid for golfers to teach a golfer the correct path to swing a golf club from the address position, and during the entire swing.

BACKGROUND OF THE INVENTION

Achieving a sound and repetitive golf swing takes a lot of training and practice, for most golfers. Considerable effort and time has been devoted, over the years, to the development of improved training devices, for the purpose of aiding both novice and experienced golfers in achieving the desired goal of making a good swing each and every time the golfer addresses the ball for the purpose of putting it into play.

Many existing training devices have drawbacks. For example, in some instances, the training devices are complicated, often involving rigid frameworks extending about the golfer. Some prior training devices use rigid frameworks which tend to hold the golfer in the correct position, or require swinging of the club in a correct plane, without giving the golfer the opportunity to train himself in the correct posture, swing plane, and the several other basic fundamentals required if one is to swing a golf club correctly.

Further, most existing training devices do not allow the golfer to strike the ball and make an uninhibited full swing, as part of the training exercise.

For these and other reasons, many of the prior art golf swing training devices have not been successful.

It is an object of the present invention to overcome the drawbacks in the prior art devices, by providing a training device which has a light and simple construction and which is easy for the golfer to use.

It is an object of the present invention to provide a device for training a golfer, which imparts to the user a feel for sensing correct swing fundamentals, transmitted through both hands and arms, including all of the basic aspects of a golf swing, such as grip, set-up, takeaway, a proper turn, a proper weight shift, and a good follow-through.

It is an object of the present invention to provide an improved training device which permits it to be used in training a golfer in the correct fundamentals of all aspects of the game, from putting, chipping, pitching, half, three-quarter, and full swings.

It is also an object of the present invention to provide a training device that is capable of manufacture at relatively low cost, will offer minimum impedance to the user's movements, and will be of long-lasting and durable construction.

DESCRIPTION OF THE PRIOR ART

Expired U.S. Pat. No. 4,071,251 entitled "Golf Swing Training Device" discloses a golf swing training device having at least one pair of adjustable and flexible guide rails, the guide rails controlling the swing path and swing plane of a golf club swung between them. A clubhead guide may also be incorporated in the device to insure that the clubhead does not top the ball. The flexible guide rail is supported by a spring construction which permits the flexible guide rail to swing away from the other guide rail in response to impacts with the shaft of the golf club. The flexible guide rail includes an audible signaling device and the ends of such rail are positioned at an angle with the plane of the other guide rail to facilitate guiding the golf club into the hitting zone.

U.S. Pat. No. 4,949,974 entitled "Golf Training Apparatus" discloses a golf training apparatus having a frame having a base for sitting on the ground and a golf club swing guide attached to the frame for guiding a person's swing of a golf club. A guide adjustment system allows for the adjustment of the position of the first golf club swing guide as to both height and tilt of the guide. The frame and swing guides may be made of a PVC (or polyethelene) pipe and may have special PVC attachments utilizing standard PVC couplings. Adjustments are made by telescoping the pipe to the desired position and locking them in place. The swing guide has an arcuate segment and a replaceable connecting segment connecting the ends of the arcuate segment so that the swing guide an be adjusted for size and shape from a complete circle to customized shape for the swing of a golfer. The frame may have a motor attached thereto and connected to a crank arm mechanism which is coupled to the swing guide for rapidly moving the swing guide during a practice swing. A microswitch is positioned adjacent the swing guide in a predetermined position to actuate the motor to move the swing guide at the predetermined point in the swing pattern.

U.S. Pat. No. 5,303,926 entitled "Multi-Use Golf Training Device" discloses a portable golf swing practice device. The practice device includes a weighted base and an upstanding flute guide post with a positioning bar adjustably mounted between ear portions of a post encircling locking jaw which is vertically and rotatably adjustable on the guide post. By setting the positioning bar in any one of a plurality of positions relative to the user, each of the proper body positions and swing motions can be reinforced thus improving the user's stance and wring during actual playing. All components of the device are made of a rigid high strength polyvinglchloride to prevent corrosion.

SUMMARY OF THE INVENTION

The present invention is for a golf training aid designed to teach a golfer the correct path to swing a golf club from the set up position to the top of the swing to impact and follow through. Specifically, this invention includes a golf training aid in the form of a tubular frame with adjustable poles, preferably made of light weight aluminum or PVC (polyvinyl chloride); and covered foam. The golf training aid trains a golfer by using a swing board which is set up at the correct shaft angle plane which guides the shaft of the club back approximately 18 inches. As a result of the slight friction between the swing board and the golf club shaft, the golfer will feel the correct path of their swing going back. Two shaft plane guides are provided at the waist height of the golfer. The shaft plane guides are adjustable and permit the golfer to identify their correct backswing and downswing. On the downswing, the golfer keeps the club below the shoulder plane guide and above the shaft plane guide and the swing board, thus putting the club into the correct downswing position. The club will return slightly above the swing board to impact and stay outside the follow through guide (shaft plane guide).

BRIEF DESCRIPTION OF THE DRAWINGS

Further objects, features and advantages of the present invention will become apparent upon the consideration of the following detailed description of the presently-preferred embodiment when taken in conjunction with the accompanying drawings, wherein.

DETAILED DESCRIPTION OF THE PREFERRED EMBODIMENT

The assembly 10 of the present invention is shown in FIGS. 1 to 10.

Figure 1:
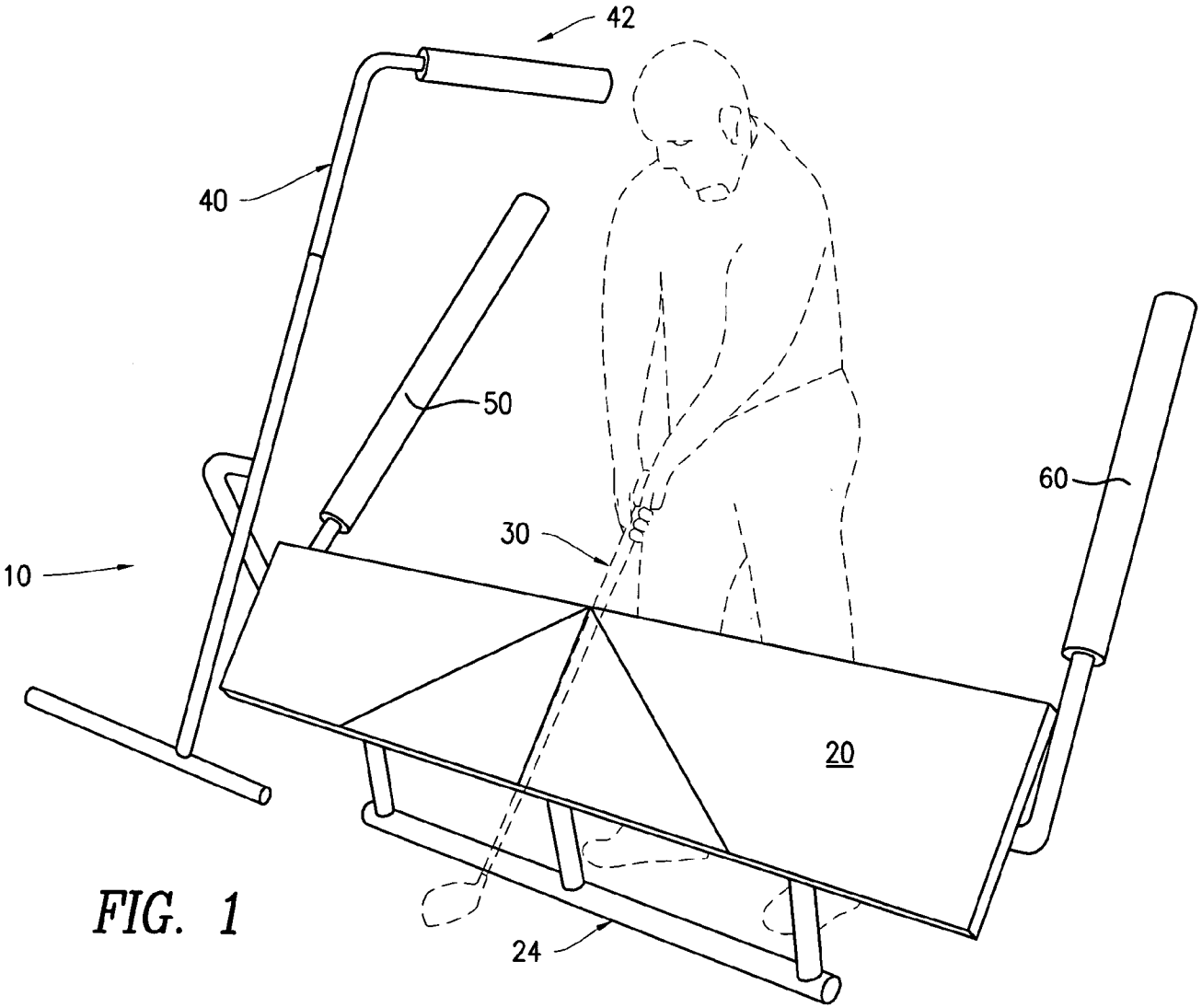
FIG. 1 is a perspective view of the assembly of the present invention, showing the golfer in the address position.
Figure 2:
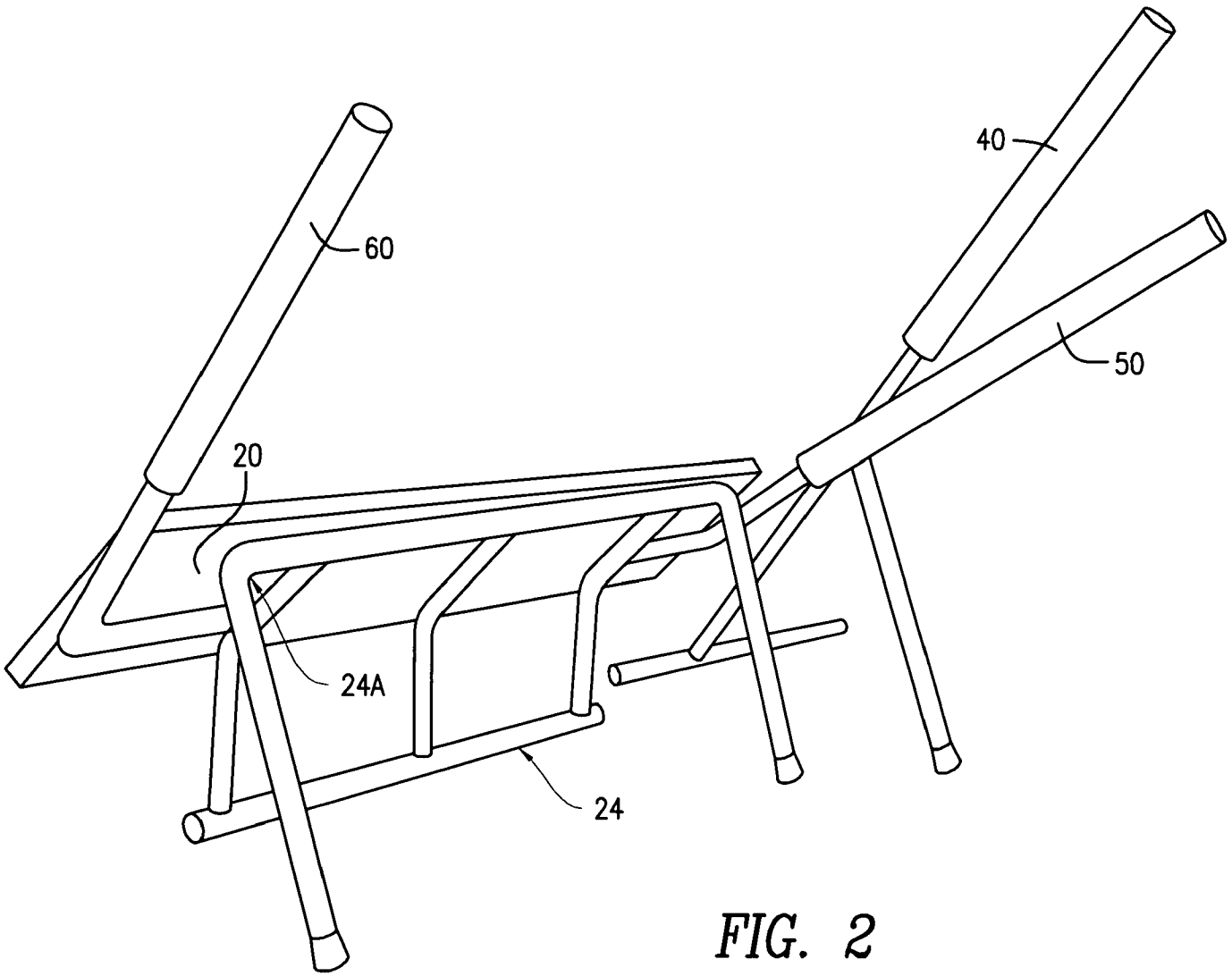
FIG. 2 is a rear view of the assembly of the present invention.
Figure 3:
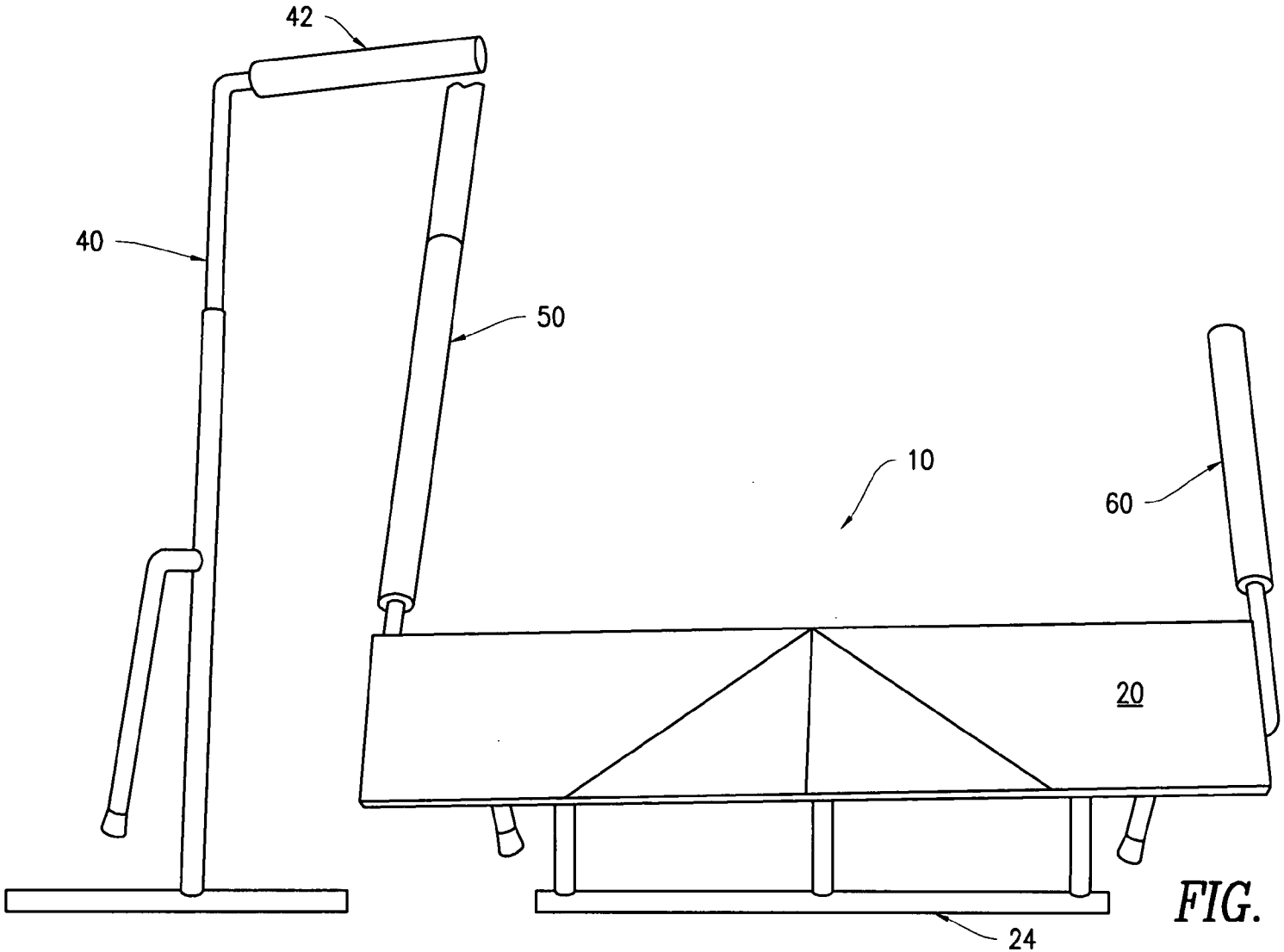
FIG. 3 is a front view of the assembly of the present invention.

During the address position, as shown in FIG. 1, the golfer assumes their natural address position, and swing board assembly 20 is adjusted so that the shaft of the club 30 is parallel to the swing board 20, while contacting the swing board 20. After establishing swing board 20 in the adjusted position by adjusting support legs 24 about hinge 24A, the golfer moves to the right and adjusts the shoulder plane guide 40. Using the address position to start the swing, the shoulder plane guide 40 and its vertical telescoping portion should be a minimum of 12 inches from the toe of the club 30 when the club is swung to the waist-high position. After this, the next step is to adjust the shoulder plane guide 40. The golfer then adjusts the foam extension 42 on guide 40 to eliminate the over the top swing fault. The swing board assembly 20 is foldable in half by hinges or by other similar means.

During the backswing, the golfer maintains club 30 in contact with the swing board 20 until club 30 leaves board 20, and allows club 30 to leave the surface of the swing board 20, so that the club is maintained above right shaft plane guide 50 and below shoulder plane guide 40 until completion of backswing.

During the downswing, the golf club 30 passes below shoulder plane guide 40 and above shaft plane guide 50, while it is positioned during movement above swing board 20 as the club 30 approaches impact with the ball, and the club 30 is maintained slightly above swing board 20 during and after impact, and is guided above left shaft plane guide 60 during the follow through swing to finish.

It is noted that right shaft plane guide 50 and left shaft plane guide 60 are each telescopically adjustable. In addition, the assembly of the present invention may be used by a right-handed or left-handed golfer.

Figure 4:
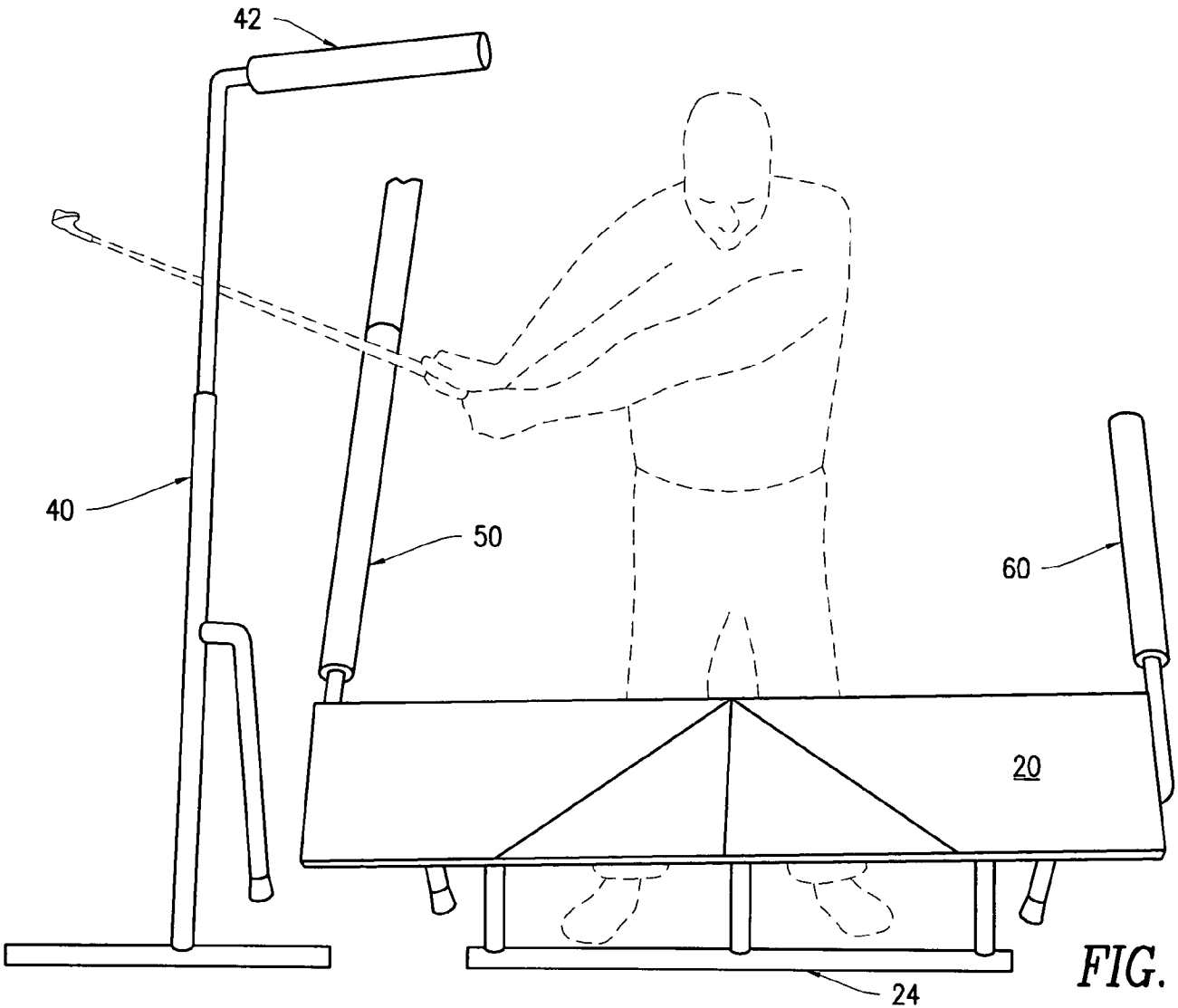
FIG. 4 is a front view of the assembly of the present invention, showing the golfer in the take away position.
Figure 5:
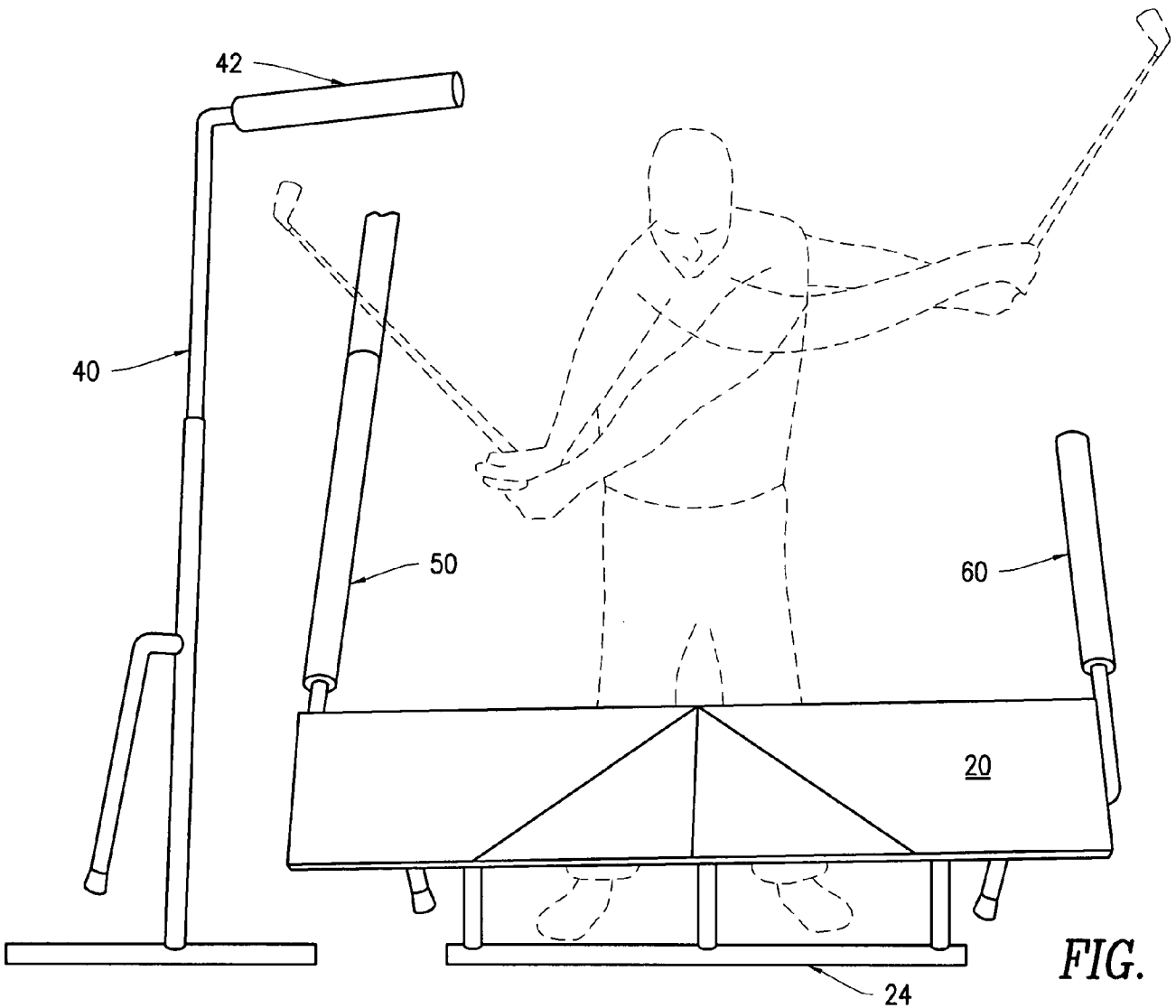
FIG. 5 is a front view of the assembly of the present invention, showing the golfer in the downswing and follow through positions.
Figure 6:
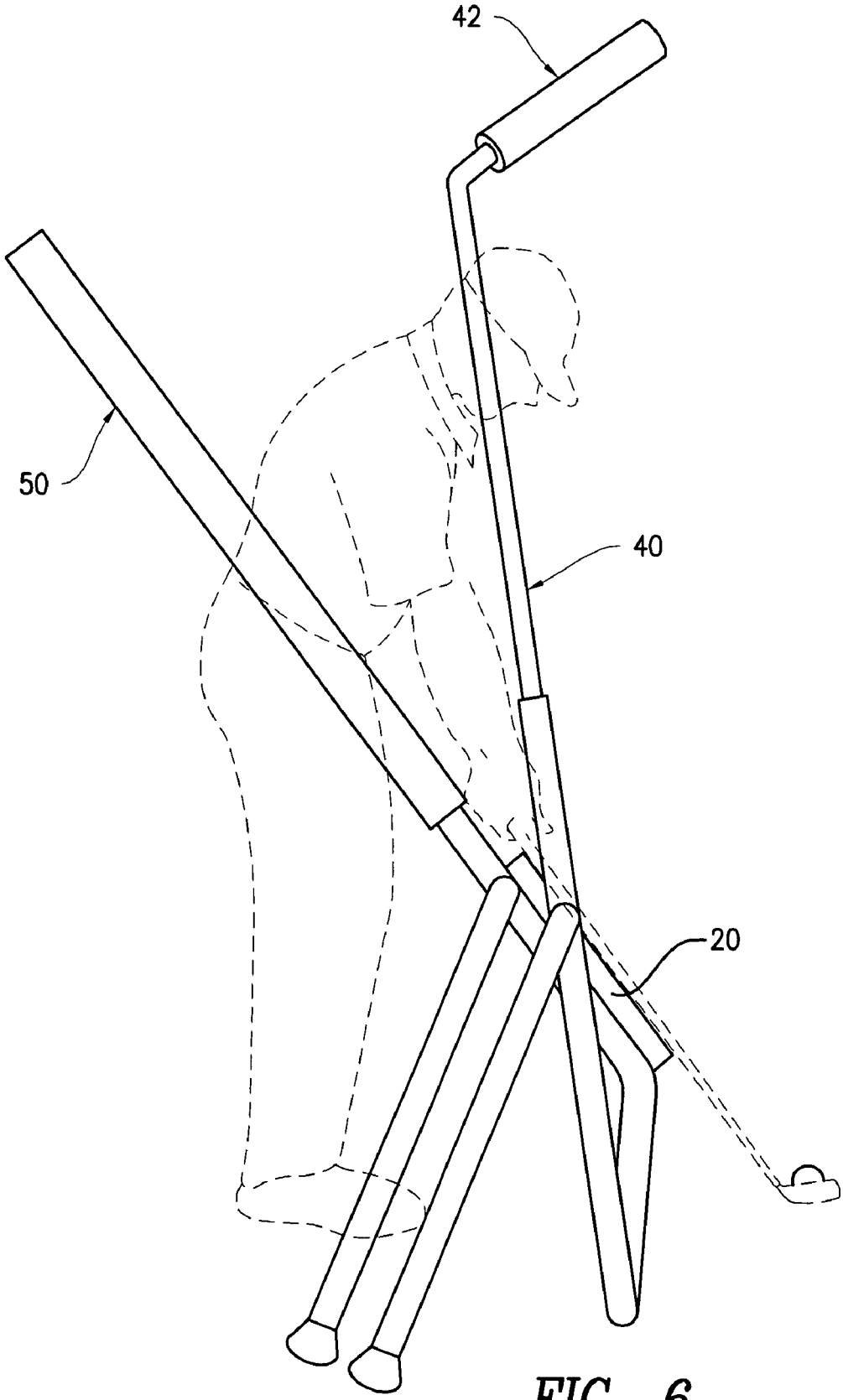
FIG. 6 shows a side view of the assembly in the address position.
Figure 7:
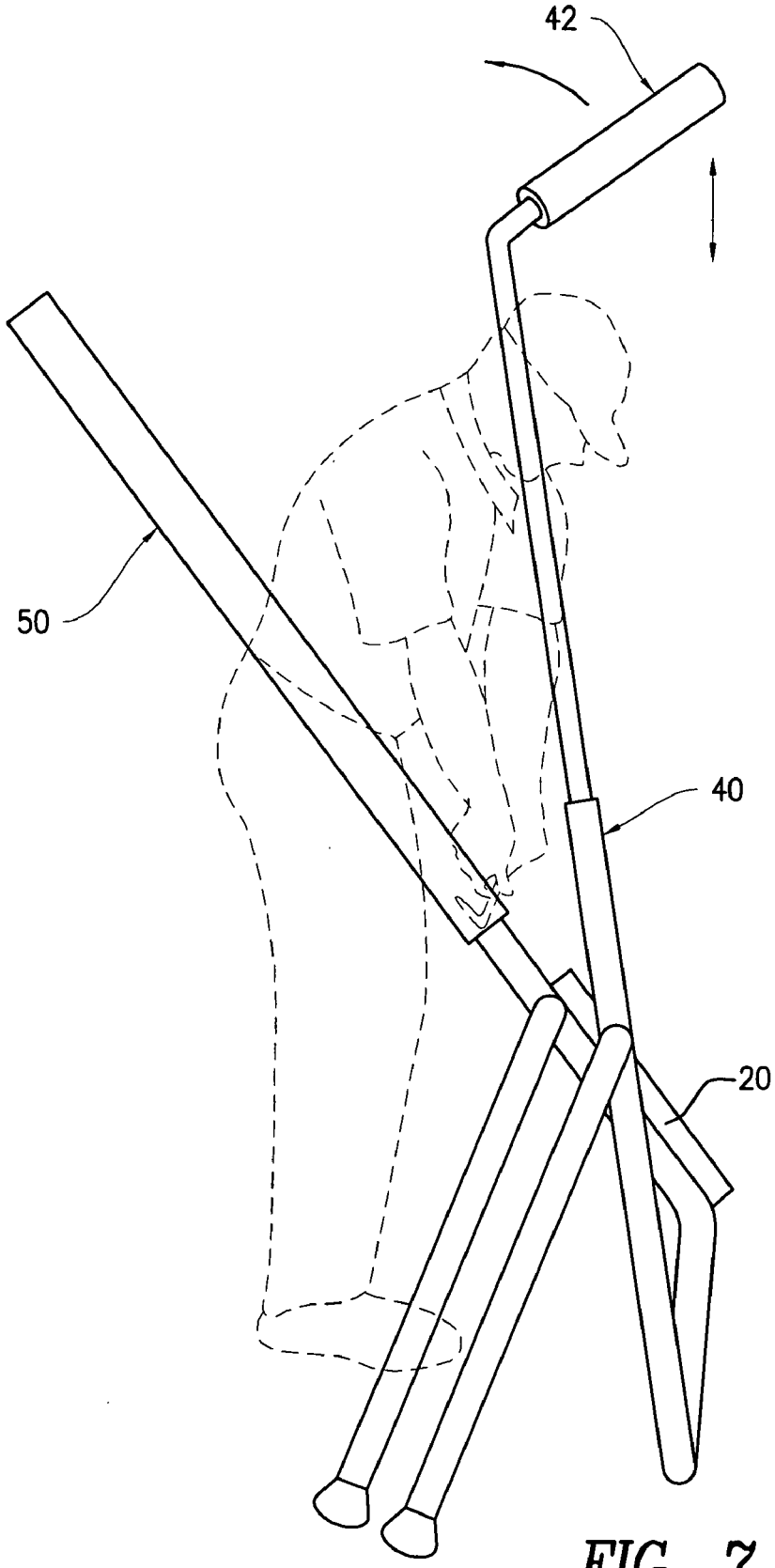
FIG. 7 shows a side view of the assembly of the take away position.

FIGS. 4 and 5 show the golfer in the take away position, and in the down swing and follow through position. FIGS. 6 and 7 show side views of the address position and the take-away position.

Figure 8:
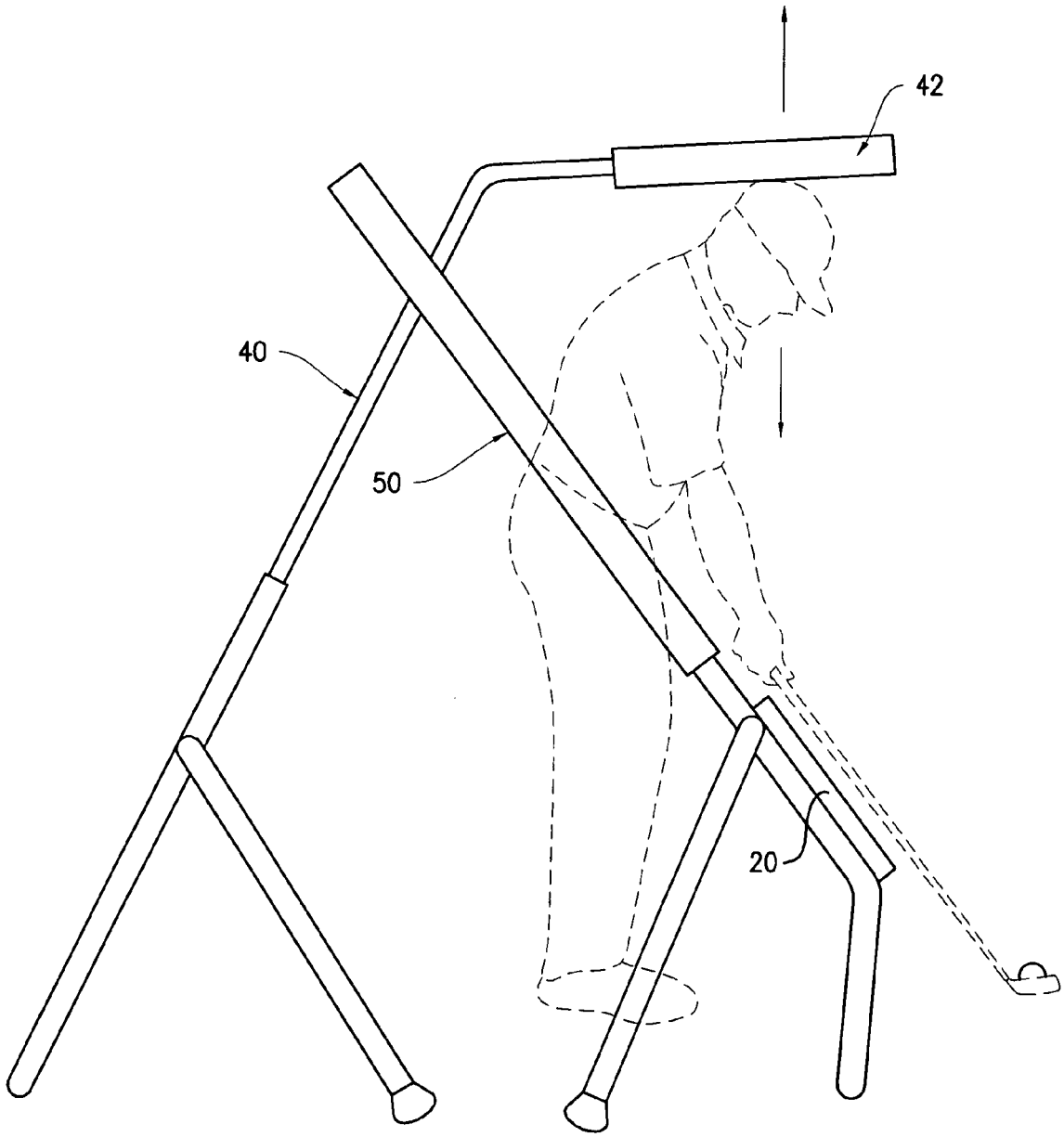
FIG. 8 shows the vertical head stabilizer in the address position.
Figure 9:
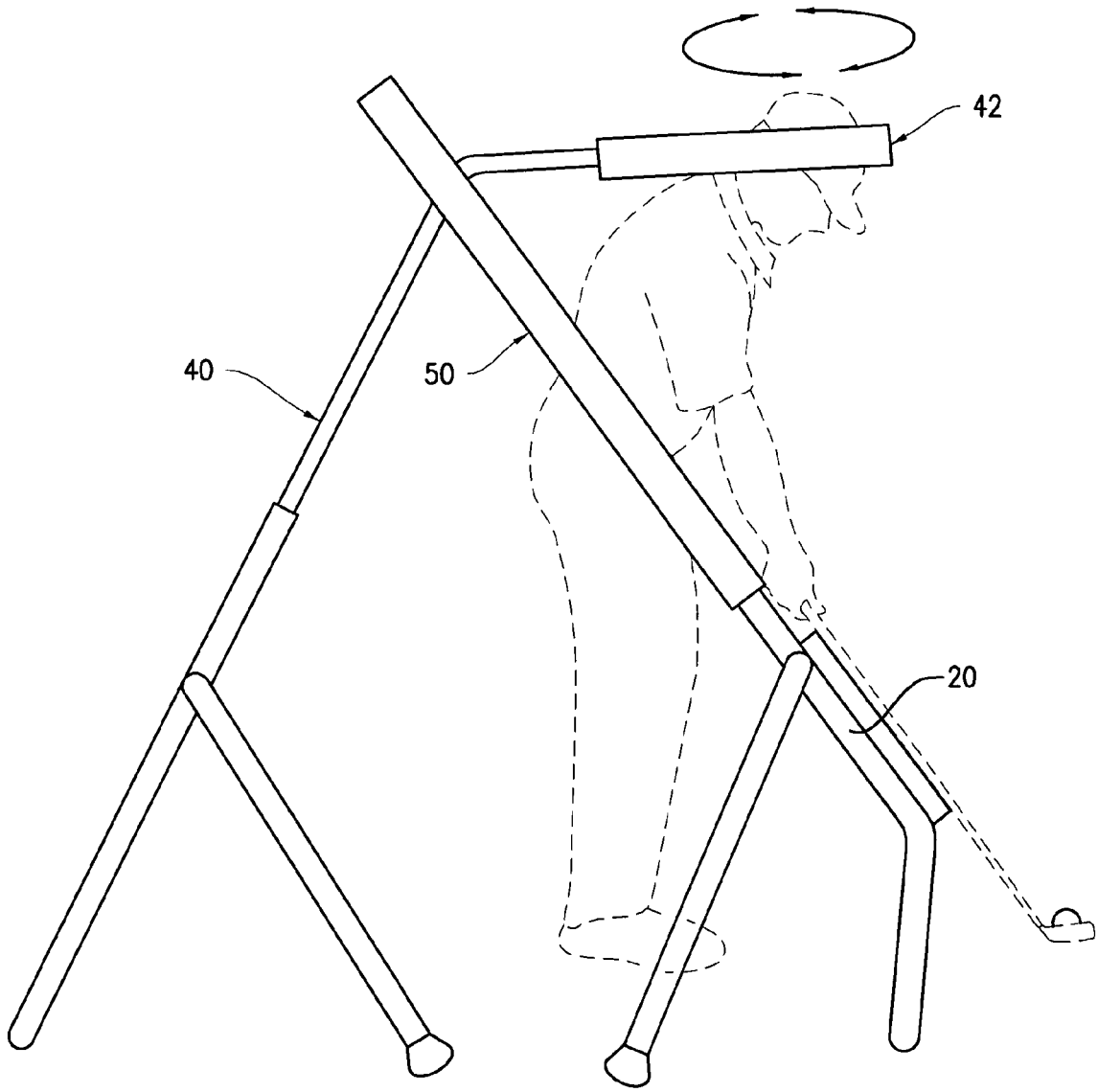
FIG. 9 shows the horizontal head stabilizer in the address position.
Figure 10:
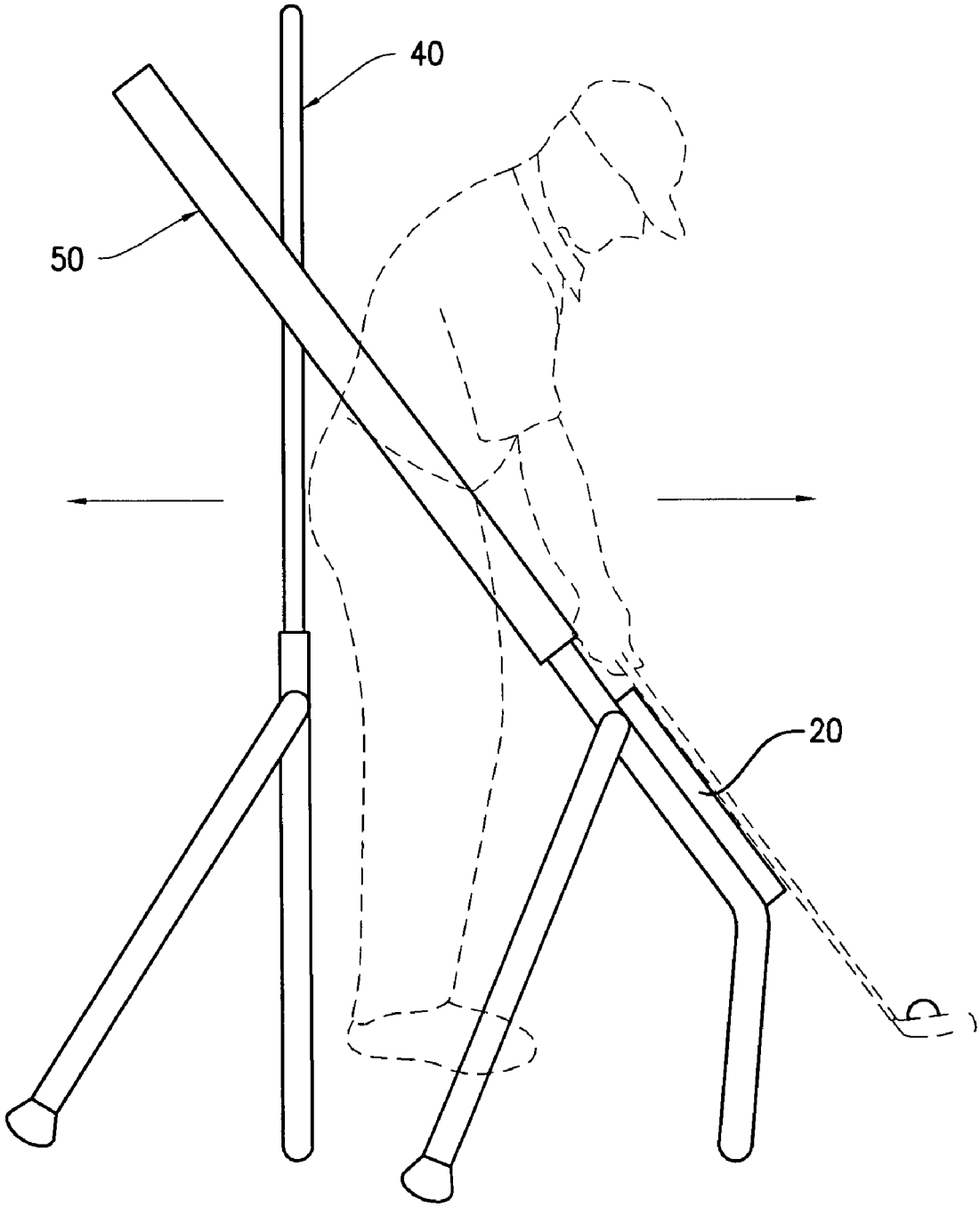
FIG. 10 shows how the posterior stabilizer in the address position.

FIGS. 8 to 10 illustrate how the head of the golfer and body of the golfer are maintained in their correct positions by the apparatus of the present invention. More particularly, FIG. 8 shows the use of the vertical head stabilizer 42, wherein the golfer sets up as usual, and adjusts the foam extension 42 on guide 40 to slightly contact the top of the head and maintain such contact during the swing. The golfer adjusts the should plane guide 40 to contact the top of the head as illustrated in FIG. 8, to maintain the head level throughout the swing. This minimizes the vertical movement of the head, and helps maintain the head in the proper position during the address position and during the swing.

As shown in FIG. 9, the horizontal head stabilizer prevents the head from moving laterally. The golfer sets up in the usual manner. In addition, the golfer adjusts the should plane guide 42 to contact the side of the head as illustrated to maintain it level and steady throughout the swing. For example, the guide 42 may be adjusted to 2-3 inches above the ear by telescopically adjusting the height of the shoulder plane 40.

FIG. 10 shows the posterior stabilizer and illustrates how the golfer maintains his posterior in the correct position during the address position and throughout the swing. As shown, the posterior of the golfer must be maintained in contact with the guide during the address position and the entire swing.

Operation of the Present Invention

To begin use, the golfer adjusts the swing board assembly 20 to the desired angle, and also adjusts the shoulder plane guide 40 to the desired height. Using the address position to start the swing, the shoulder plane guide 40 and its vertical telescoping portion should be adjusted to be a minimum of 12 inches from the toe of the club 30 when the club is swung to the waist-high position. After this, the next step is to adjust the shoulder plane guide 40. The golfer then adjusts the foam extension 42 on guide 40. The golfer then adjusts right and left shaft plane guides 50 and 60 to the desired angle and height.

During the backswing, the golfer maintains club 30 in contact with the swing board 20 until club 30 leaves board 20, and allows club 30 to leave the surface of the swing board 20, so that the club is maintained above the right shaft plane guide 50 and below shoulder plane guide 40 until completion of the backswing.

During the downswing, the golf club 30 passes below shoulder plane guide 40 and above shaft plane guide 50, while it is positioned during movement in front of swing board 20 as the club 30 approaches impact with the ball. The club 30 is maintained slightly in front of swing board 20 during and after impact, and is guided up in front of the left shaft plane guide 60 during the follow through swing to finish.

Stabilizer 42 is also adjusted to the proper position to act as a vertical head stabilizer (FIG. 8) or a horizontal head stabilizer (FIG. 9), or as a posterior stabilizer (FIG. 10).

The foregoing operation of the present invention helps to improve all aspects of the golfer's swing, in an easy and simple manner.

ADVANTAGES OF THE PRESENT INVENTION

An advantage of the present invention is that it overcomes the drawbacks in the prior art devices, by providing a training device which has a light and simple construction and which is easy for the golfer to use.

An advantage of the present invention is that it provides a device for training a golfer, which imparts to the user a feel for sensing correct swing fundamentals, transmitted through both hands and arms, including all of the basic aspects of a golf swing, such as grip, set-up, takeaway, a proper turn, a proper weight shift, and a good follow-through.

An advantage of the present invention is that it provides an improved training device which permits it to be used in training a golfer in the correct fundamentals of all aspects of the game, from putting, chipping, pitching, half, three-quarter, and full swing.

An advantage of the present invention is that it provides a training device that is capable of manufacture at relatively low cost, will offer minimum impedance to the user's movements, and will be of long-lasting and durable construction.

A latitude of modification, change and substitution is intended in the foregoing disclosure, and in some instances, some features of the invention will be employed without a corresponding use of other features. Accordingly, it is appropriate that the appended claims be construed broadly and in a manner consistent with the spirit and scope of the invention herein.

What is claimed is:

1. A portable golf training aid for correcting over swing faults, for guiding a backswing, a downswing, and a follow through swing, and for correcting other swing faults, comprising:

a) a swing board assembly having a front surface for guiding the movement of the golf club shaft along the surface of said swing board assembly;

b) means for adjusting the angle of said front surface to maintain the proper angle of the golf shaft;

c) a shoulder plane guide positioned adjacent to said swing board assembly for use in cooperation with each other; said shoulder plane guide having an adjustable extension for correcting the over the top swing fault and other swing faults, and for guiding the back swing;

d) left and right shaft plane guides connected to said swing board assembly for guiding the backswing, the downswing, and the follow through swing; and e) a vertical stabilizer and a horizontal stabilizer for use in cooperation with said swing board assembly for maintaining the head, spine, and pelvis area of the golfer in a proper aligned golf position.

2. A golf training aid, in accordance with claim 1, wherein said shoulder plane guide is telescopically adjustable, and said adjustable extension is rotatable up to 360°, relative to the head of the golfer.

3. A golf training aid, in accordance with claim 1, wherein said swing board assembly includes means for folding said swing board assembly into a smaller size for transport.

4. A golf training aid, in accordance with claim 1, wherein said stabilizer is a vertical head stabilizer, or a horizontal head stabilizer, or a posterior stabilizer.

* * * * *